US005860370A

United States Patent [19]

Poniecki

[11] Patent Number: 5,860,370

[45] Date of Patent: Jan. 19, 1999

[54] UNIVERSALLY ADJUSTABLE, PORTABLE SHELVING UNIT

[76] Inventor: Andy Poniecki, 6336 W. Melrose, Chicago, Ill. 60634

[21] Appl. No.: 867,165

[22] Filed: Jun. 2, 1997

[51] Int. Cl.[6] ..... A47B 11/00

[52] U.S. Cl. ..... 108/137; 108/153.1; 248/219.3; 248/246; 248/295.11; 211/182

[58] Field of Search ..... 108/137, 153.1, 108/180; 248/218.4, 219.3, 246, 295.11, 311.2; 211/182, 175, 289

[56] References Cited

U.S. PATENT DOCUMENTS

| | | | |
|---|---|---|---|
| 1,830,347 | 11/1931 | Camden et al. | 108/137 |
| 2,846,570 | 8/1958 | Harling | 248/219.3 X |
| 3,955,511 | 5/1976 | Bak | 108/137 |
| 4,178,844 | 12/1979 | Ward et al. | 108/137 X |
| 4,524,792 | 6/1985 | Tzabanakis | 248/218.4 X |
| 5,154,386 | 10/1992 | Heck | 248/218.4 X |
| 5,417,168 | 5/1995 | Soper | 108/116 X |
| 5,509,541 | 4/1996 | Merl | 248/218.4 X |
| 5,566,916 | 10/1996 | Bailey | 248/218.4 X |

FOREIGN PATENT DOCUMENTS

| | | | |
|---|---|---|---|
| 741980 | of 1932 | France | 211/182 |
| 2287874 | 5/1976 | France | 108/137 |
| 476616 | 12/1937 | United Kingdom | 248/218.4 |

*Primary Examiner*—Peter M. Cuomo
*Assistant Examiner*—Hanh V. Tran
*Attorney, Agent, or Firm*—John D. Gugliotta

[57] ABSTRACT

A portable, self mounting shelf is made of a plurality of generally tubular legs and cross members. A first adjustable leg and second adjustable leg are held within the same horizontal plane by a center adjustable crossbar and a rear adjustable crossbar. A holding foot is affixed each to the first leg and the second leg at the end opposite the rear crossbar. Pivotal attachment are included capable of allowing rotation of the legs about the crossbars in a pivoting manner along the same horizontal plane.

6 Claims, 5 Drawing Sheets

UNIVERSALLY ADJUSTABLE, PORTABLE SHELVING UNIT

BACKGROUND OF THE INVENTION

1. Field of the Invention

The present invention relates generally to portable shelving and, more particularly, to a universally adjustable, portable shelving unit that is nonpermanently mounted and vertically adjustable without rigid fasteners 2. Description of the Related Art In the related art, many improvements are known for adjustable shelves. For example, in U.S. Pat. No. 5,221,013, issued in the name of Santucci, an adjustable self supporting shelf is disclosed which allows the user to adaptable include a portable shelving unit without rigid fasteners. However, a shelf made in accordance with the Santucci disclosure requires placement between two relatively parallel, vertical surfaces in order to remain self supporting.

Another example of an improved shelf is disclosed in U.S. Pat. No. 5,188,246, and U.S. Pat. No. 5,097,969, both issued in the name of Maxworthy. Such shelves, however, require a horizontally slatted wall to insert into for support. Similarly, in U.S. Pat. No. 4,533,056 issued in the name of Krikorian, a wire shelf and bracket therefor are disclosed requiring some form of vertical, slatted surface for support.

Further, in U.S. Pat. No. 4,832,209, issued in the name of Schafer, a shelf of laminated material is disclosed, wherein the improvement appears to be an otherwise conventional horizontal shelf having improved vertical rigidity. Similarly, in U.S. Pat. No. 3,986,616, issued in the name of Gray, a shelf with end flange caps is disclosed, also providing improved vertical rigidity.

In U.S. Pat. No. 4,754,711, issued in the name of Solomon, an adaptable frame is disclosed for portably and adjustably supporting a horizontal shelf. The frame as envisioned in Solomon, however, although envisioned as a stand-alone support frame, is required to rest upon a stable, flat, horizontal surface in order to safely support a shelf.

Although these and other shelf designs provide adaptable, portable support for a variety of items and under a variety of circumstances, there remains many unique situations where such a need remains unfulfilled. The present invention is directed to providing adaptable shelving capable of adjusting to portably grip in a positive seated manner to any shape column, configured panel, door, or the like.

SUMMARY OF THE INVENTION

It is therefore an object of the present invention to provide a portable shelve for mounting to vertical posts or similarly vertically elongated structures.

It is another abject of the present invention to provide a portable shelve system for mounting without the necessity of conventional fasteners such as screws, clamps, brackets and the like.

It is yet another object of the present invention to provide a shelving system that is adjustable to the shape of a object to which it is affixed It is a further object of the present invention to provide a portable shelving system that can be manufactured from a variety of construction materials, such as wood, metal, or plastic.

It is a feature of the present invention to provide an improved shelf that utilizes a rear cross member that creates pressure on three sides of the vertical object to which it is affixed.

Briefly described according to the first preferred embodiment of the present invention, a vertically self supporting shelf is non-permanent mounting is provided that is adaptable to various shaped and sized objects. Capable of attaching to any vertically elongated post (round, square, "u" shaped, "t" shaped, etc.) The present invention provides two horizontally adjustable frontal vertical legs and a center rear adjustable leg that will accomplish a positive affixment seat despite the post's shape. Uniform distribution of forces are applied across the shelf is accomplished, with no vertical slippage.

According to a slightly modified second preferred embodiment, the shelf can be used on the edges of doors or panels having a thickness of between 1 inch to 4 inches or more, without damaging the panel surface.

An advantage of the present invention is that the shelf is held square to any shaped vertical support post.

Another advantage of the present invention is that is vertically adjustable.

Yet another advantage of the present invention is that is can be not permanently mounted, and therefore, portable.

Further, the present invention is capable of adjusting to portably grip in a positive seated manner to any shape column, capable of mounting without the necessity of conventional fasteners such as screws, clamps, or brackets, is adjustable to the shape of an object to which it is affixed, and can be used to support objects within a wide range of weights depending upon the materials of construction.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
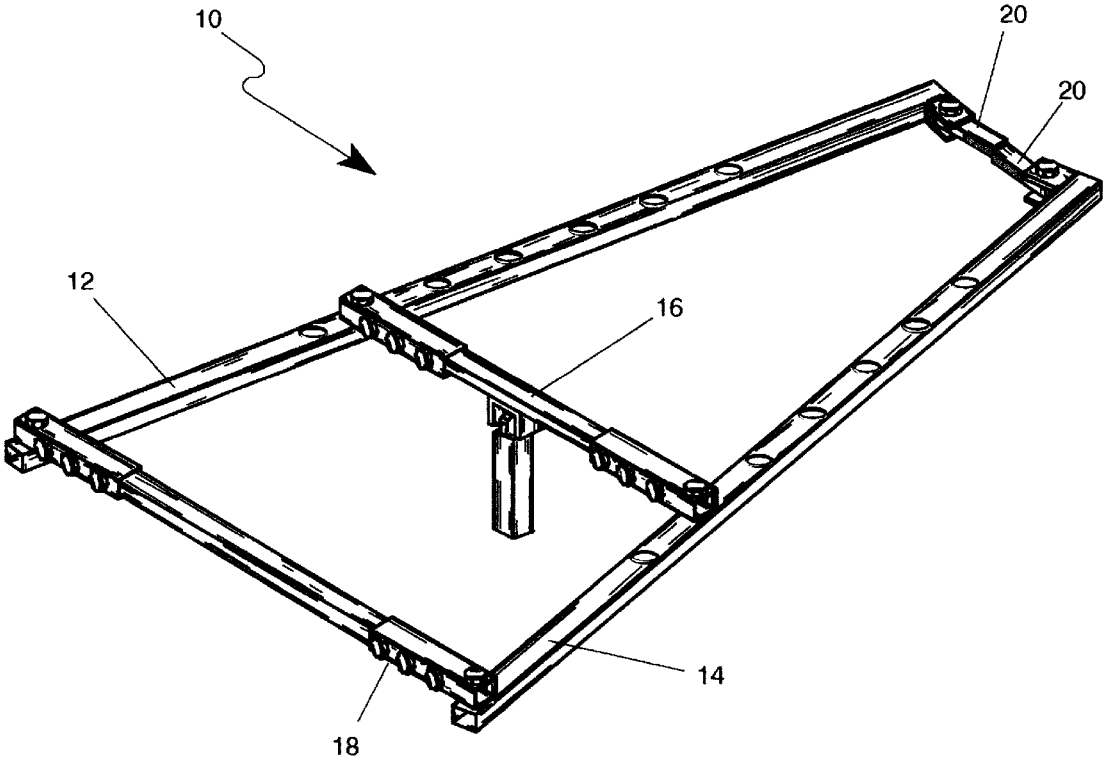
FIG. 1 is a perspective view of a universally adjustable, portable shelving unit according to the preferred embodiment of the present invention.

As shown in FIG. 1, a portable, self mounting shelf 10, according to the preferred embodiment of the present invention, is shown formed from a plurality of generally elongated, tubular members, each having a generally square cross sectional shape. A first adjustable leg 12 is aligned within the same horizontal plane with a second adjustable leg 14. The first leg 12 and second leg 14 are held together in the middle by a center adjustable crossbar 16 and a rear adjustable crossbar 18. The center crossbar 16 connects together the legs 12, 14 at a midpoint of the legs, and the rear crossbar connects together the legs 12, 14 at one end of the legs. The elongated legs 12, 14, each have a holding foot 20 affixed thereto at the end opposite the rear crossbar 18.

Figure 2:
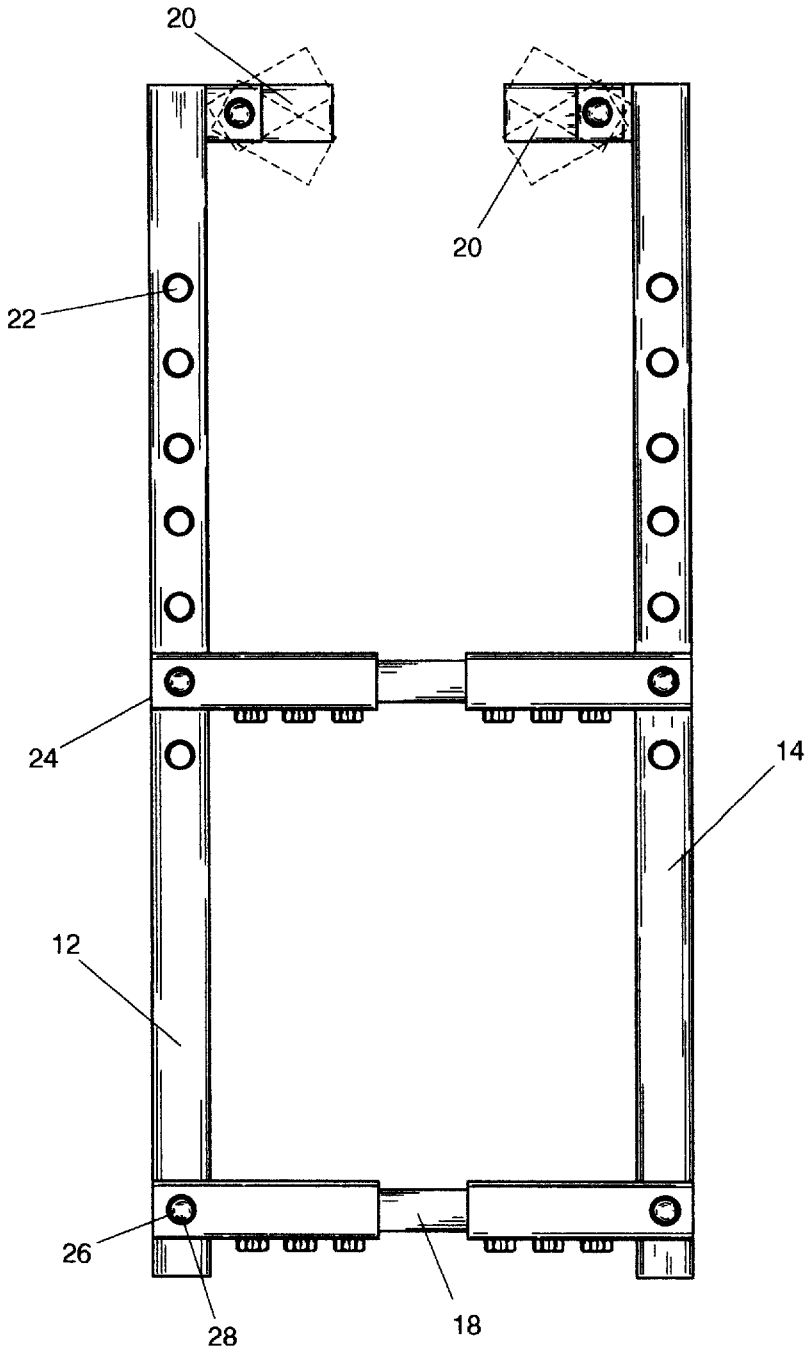
FIG. 2 is a top plan view thereof.
Figure 4:
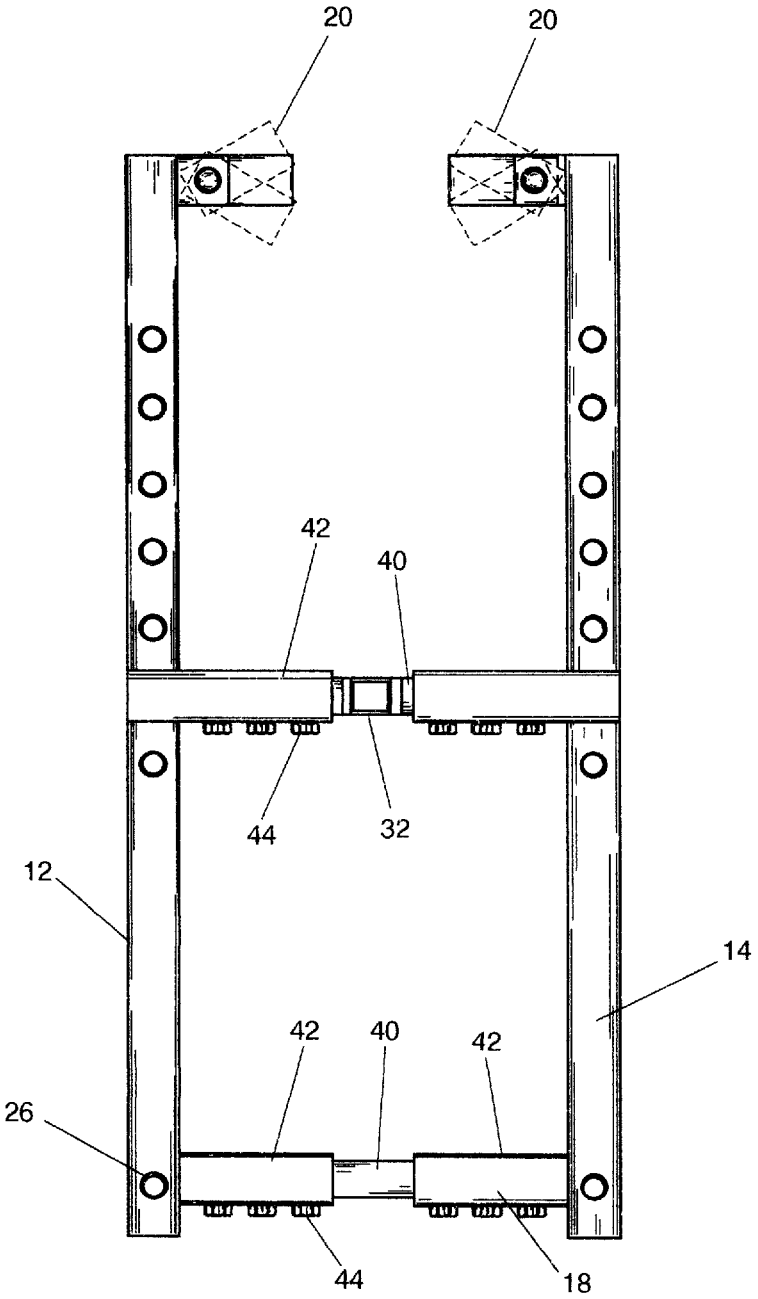
FIG. 4 is a bottom plan view thereof.

As best shown in FIG. 2 and FIG. 4, the interrelation of the various legs and crossbars is more clearly shown. Both the first leg 12 and second leg 14 are generally linearly elongated. Although other shapes are envisioned, in its preferred embodiment each said leg is formed of a generally tubular member having a square cross sectional shape. As such, four surface faces are formed. Along the top surface face a formed a series of linearly aligned positioning orifices 22. It is envisioned in a preferred embodiment that each leg 12, 14, (as well as other crossbar members) could be formed of a tubular, hollow metal material, such as plastic, iron, steel, or aluminum. As such, the positioning orifices 22 would comprise a circular penetration through the upper surface only. In one other particular embodiment that is presently envisioned, each leg 12, 14, (as well as other crossbar members) could be formed of a tubular, solid material, such as wood, plastic, iron, steel, or aluminum. As such, the positioning orifices 22 would comprise a recess into the body of the leg 12, 14, thereby penetrating through the upper and into the inner space of the leg only. A rear crossbar receiving orifice 26 is formed at the rearmost end of each leg 12, 14 in a similar manner. In either structural variation, a pair of first pivotal attachments 24 are used to affix each end of the center crossbar 16 to the first and second legs 12, 14 respectively at one of these positioning orifices 22. A pair of second pivotal attachments 28 are used to affix each end of the rear crossbar 18 to the first and second legs 12, 14 respectively at one of each of this orifices 26. The pivotal attachments 24, 28 are envisioned as being similar to each other, and capable of being generally conventional, such as rivets, screws, bolt/nut combinations, and the like. Each pivotal attachment 24,28 is designed to allow rotation of the legs 12, 14 about the crossbars 16, 18 in a pivoting manner along one (the same) horizontal plane. It can therefor be seen by one skilled in the art and with the aid of the present disclose that various detailed designs for each pivotal attachment 24, 18 can be included within the scope of the present disclosure, depending upon the choice and selection of member designs, (i.e., hollow metal, solid wood, injection molded plastic, etc.)

A third pivotal affixment means 30 is shown for affixing the holding foot 20 at the distal end of each leg 12, 14, and will be discussed in greater detail below.

Figure 3A:
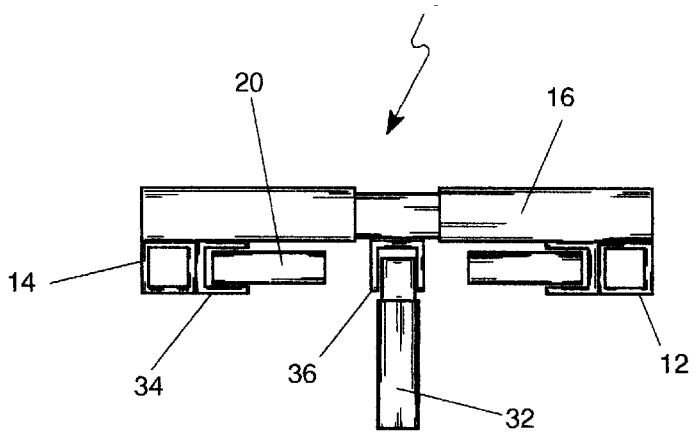
FIG. 3*a* is a front elevational view thereof.

In FIG. 3*a,* a rear elevational view of the shelf 10, showing in greater detail the holding foot 20 and a center angle adjustable support member 32. Each holding foot 20 is affixed to the end of the leg 12, 14 by use of a "C" shaped retaining clamp 34 in which the holding foot 20 can be pivotally recessed into. A retaining pin (not shown) or other similar and conventional means of retaining the foot 20 within the clamp 34 is used. Each foot 20 is pivotally disposed inward toward the shelf centerline and toward each opposite foot 20.

Figure 3B:
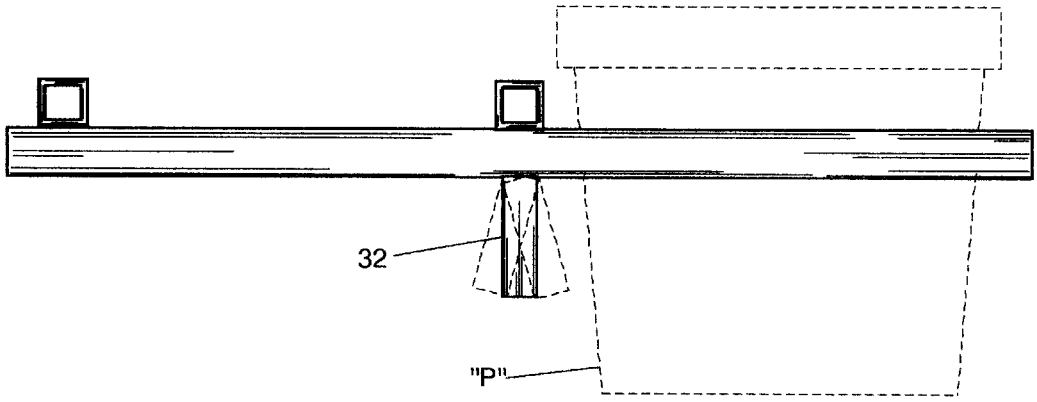
FIG. 3*b* is side elevational view thereof, the opposite side being a mirror image.
Figure 5A:
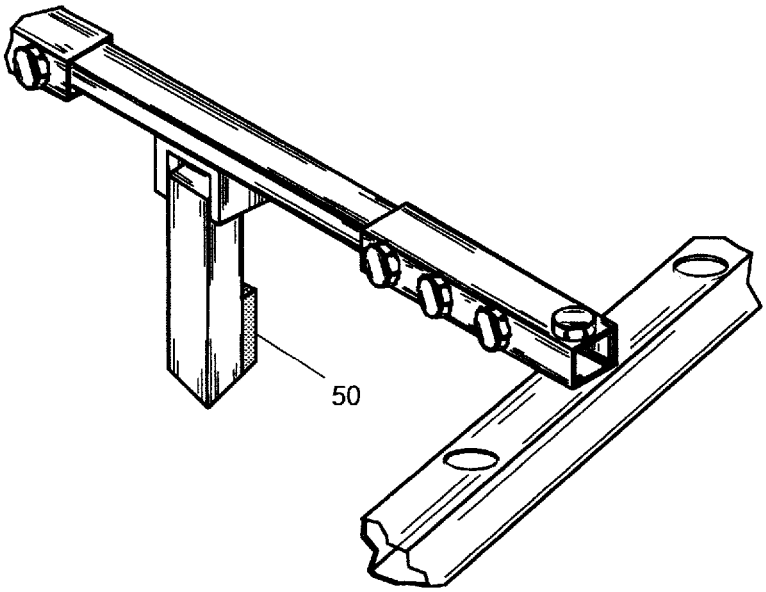
FIG. 5*a* is an exploded, detailed perspective view of the hinge point between a side leg member and the front cross member.

In a relatively similar fashion, it is envisioned that the center angle adjustable support member 32 is affixed to the bottom surface of the center crossbar with an inverted "U" shaped retaining clamp 36 in which the center angle adjustable support member 32 is pivotally recessed into. A retaining pin (not shown) or other similar and conventional means of retaining the center member 32 within the clamp 36 is used. The center member 32 is pivotally disposed downward. As best shown in FIG. 3*b,* the center angle adjustable support member 32 is disposed downward and pivots along a single vertical plane such as to provide a straightening support means for a pot or planter "P" or other similar object. Shown in greater detail in FIG. 5*a,* a frictional retaining means 50, such as a cushion, a pad, or other similar friction increasing element is affixed to the inner surface of the center angle adjustable support member 32 in order to provide firm mechanical contact with the pot or planter "P" without causing damage.

As shown in FIG. 4, each cross bar is comprised of a nested inner member 40 slidably retained within a pair of disposed telescoping outer members 42. A frictional impingement holding means 44 for fixing the inner member within the outer members is included, and envisioned as a conventional clamping means utilizing screws, threaded rod, bolt and nut combinations, or the like.

Figure 5B:
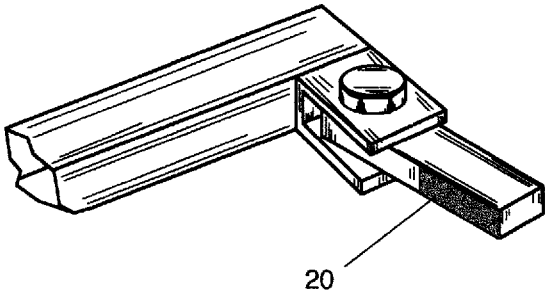
FIG. 5*b* is an exploded, detailed perspective view of a foot hinge point along the rear end of a side leg member.

As shown in greater detail in FIG. 5*b,* the foot 20 is shown, and in which the foot 20 is capable of pivotal translation inward. As such, each foot 20 can be translated inward in order to come into firm mechanical contact with an object held within the shelf 10.

2. Operation of the Preferred Embodiment

As depicted in the various figures, a pot, planter, or other similar object can be held in and supported by the present shelf 10. The articulating, adjustable legs 12, 14 in conjunction with the center crossbar 16 operate to firmly grasp in a mechanical manner a supported object such as a pot or planter. Various sizes and shapes can be accommodated. Further, the center angle adjustable support member 32 is moved into a guiding and supporting position to keep the pot or planter in a vertically aligned position. The center rear adjustable crossbar 16 and rear adjustable crossbar 18 are then used to wedge in a firm mechanical manner around a vertical column, post, or the like. As such, the shelf 10 is self supporting.

The foregoing description is included to illustrate the operation of the preferred embodiment and is not meant to limit the scope of the invention. The scope of the invention is to be limited only by the following claims.

What is claimed is:

1. A portable, self mounting shelf comprising a first leg;

a second leg, said second leg being aligned within the same horizontal plane with said first leg;

a center crossbar for connecting together said first leg to said second leg at a midpoint of each respective leg, wherein said center crossbar is linearly adjustable in length and formed in a generally elongated, tubular manner having a generally square cross sectional shape and thereby forming four surface faces;

a rear adjustable crossbar for connecting together said first leg to said second leg at one extreme end of said respective logs wherein said rear adjustable crossbar is formed in a generally elongated, tubular manner having a generally square cross sectional shape and thereby forming four surface faces;

a holding foot, affixed onto each of said first leg and said second leg at the end opposite the rear crossbar;

a series of linearly aligned positioning orifices formed along the upper surface of each said leg; and a rear crossbar receiving orifice formed at the rearmost end of each said leg.

2. The self mounting shelf of claim 1, further comprising:

a pair of first pivotal attachments for affixing each end of the center crossbar to the first and second legs respectively at one of said positioning orifices;

a pair of second pivotal attachments for affixing each end of the rear crossbar to the first and second legs respectively at one of each of this orifices;

a pair of third pivotal affixment means for affixing the holding foot at the distal end of each leg and allowing each foot to be pivotally disposed inward toward the shelf centerline and toward each opposite foot;

and wherein each pivotal attachment is capable of allowing rotation of the legs about the crossbars in a pivoting manner along the same horizontal plane.

3. The self mounting shelf of claim 2, wherein each said first and second pivotal attachments are similar to each other, and are selected from a group consisting of rivets, screws, bolt/nut combinations.

4. The self mounting shelf of claim 2, wherein each holding foot is affixed to the end of one leg by use of a "C" shaped retaining clamp in which the holding foot can be pivotally recessed into and secured by a conventional retaining pin.

5. The shelf mounting shelf of claim 2, further comprising:

a center angle support member, said center angle support member being linearly adjustable in length and affixed to the bottom surface of the center crossbar by an inverted "U" shaped retaining clamp such that said center angle support member is pivotally recessed into said "U" shaped retaining clamp and is pivotally disposed downward along a single vertical plane such as to provide a straightening support means for supporting an object placed on said shelf.

6. The self mounting shelf of claim 2, wherein said center adjustable crossbar and said rear adjustable cross bare each is comprised of:

a pair of telescoping outer members;

a nested inner member slidably retained within said pair of disposed telescoping outer members; and frictional impingement holding means for fixing the inner member within the outer members.

* * * * *